United States Patent [19]

Guslits

[11] Patent Number: 4,993,356

[45] Date of Patent: Feb. 19, 1991

[54] MAGNETIC BRUSH DEVELOPMENT STATION HAVING A READILY ACCESSIBLE INTERIOR

[75] Inventor: Vladimir S. Guslits, Rochester, N.Y.

[73] Assignee: Eastman Kodak Company, Rochester, N.Y.

[21] Appl. No.: 246,597

[22] Filed: Sep. 20, 1988

[51] Int. Cl.[5] ..... G03G 15/09

[52] U.S. Cl. ..... 118/657; 355/245; 355/251

[58] Field of Search ..... 355/245, 251, 253, 259, 355/260; 118/653, 657, 658

[56] References Cited

U.S. PATENT DOCUMENTS

| | | | |
|---|---|---|---|
| 3,358,637 | 12/1967 | Shearer et al. | 118/658 X |
| 3,872,829 | 3/1975 | Rattin | 118/658 |
| 3,924,567 | 12/1975 | Koeleman et al. | 118/657 X |
| 3,954,331 | 5/1976 | Smith | 118/653 X |
| 4,442,790 | 4/1984 | Swapceinski et al. | 118/657 |
| 4,699,495 | 10/1987 | Hilbert | 355/253 |

*Primary Examiner*—Fred L. Braun

*Attorney, Agent, or Firm*—Lawrence P. Kessler

[57] ABSTRACT

A reproduction apparatus magnetic brush developer station having a housing including an upper and lower portion, a plurality of members including at least one set of magnets, a developer transport mechanism, and a developer material mixer. The set of magnets is rotatably supported in the upper portion of the housing. The lower portion of the housing, which provides a reservoir adapted to contain a mixture of carrier particles and pigmented marking particles, rotatably supports the transport mechanism and mixer. A drive mechanism is provided to rotate the set of magnets, transport mechanism, and mixer respectively. The upper housing portion is coupled to the lower housing portion for pivotable movement to a closed position wherein the set of magnets is in operative relation with the transport mechanism and the mixer, and to an open position wherein the set of magnets, transport mechanism, and mixer in the interior of the housing are readily accessible. The magnets, transport mechanism, and mixer are operably rotatable when the upper housing portion is in its closed or open position.

20 Claims, 9 Drawing Sheets

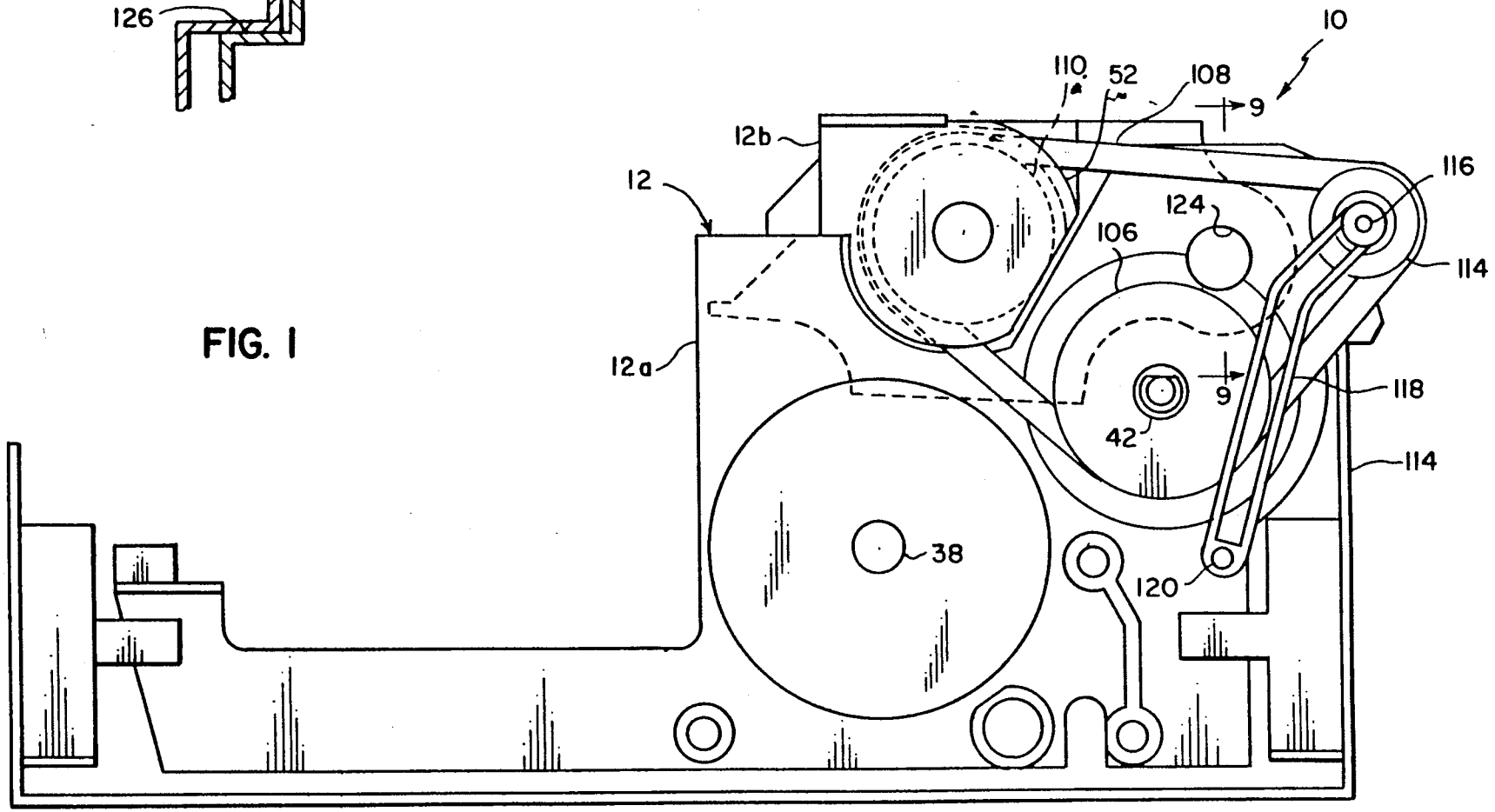
FIG. 1
FIG. 9
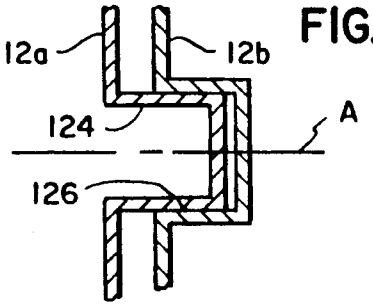

MAGNETIC BRUSH DEVELOPMENT STATION HAVING A READILY ACCESSIBLE INTERIOR

BACKGROUND OF THE INVENTION

This invention is directed in general to developer stations for reproduction apparatus, and more particularly to an improved electrostatographic reproduction apparatus developer station in which easy access to the interior of the station is provided, without completely removing the station from the apparatus, and while the drive elements of the developer station remain coupled.

In electrostatographic reproduction apparatus, it is general practice to apply a uniform electrostatic charge to a dielectric member and modify such charge to form a charge pattern corresponding in image-wise fashion to information to be reproduced. The charge pattern is then developed by applying pigmented marking particles to the dielectric member. The particles, which are charged to a polarity opposite to that of the charge pattern on the dielectric member, adhere to the pattern to form a developed image on the dielectric member. The developed image is then fixed to the dielectric member, or transferred to a final receiver member and fixed thereto by heat and/or pressure for example.

One common type of electrostatographic reproduction apparatus developer station in use today is the magnetic brush developer station. Such station includes a housing providing a reservoir for a supply of developer material. The developer material may be, for example, two component material comprising magnetic carrier particles and relatively smaller pigmented marking particles. A mechanism, such as a paddle wheel, auger or ribbon blender, is located in the reservoir and serves to stir the carrier particles and marking particle to triboelectrically charge the particles so that the marking particles adhere to the surface of the carrier particles. A transport mechanism brings the developer material into the field of a plurality of magnets which, in turn, apply the marking particles to the charge pattern on the dielectric member. While developer stations of the magnetic brush type have found wide acceptance, any problem with such a station in the field requires that the drive for the developer station elements be decoupled and the entire station be completely removed and returned to a remote location for repair. When the developer station is replaced in the reproduction apparatus, the drive for the various station elements must be carefully aligned and recoupled.

SUMMARY OF THE INVENTION

This invention relates to a magnetic brush developer station wherein the interior thereof is readily accessible. The magnetic brush developer station has a housing including an upper and lower portion, a plurality of members including at least one set of magnets, a developer transport mechanism, and a developer material mixer. The set of magnets is rotatably supported in the upper portion of the housing. The lower portion of the housing, which provides a reservoir adapted to contain a mixture of carrier particles and pigmented marking particles, rotatably supports the transport mechanism and mixer. A drive mechanism is provided to rotate the set of magnets, transport mechanism, and mixer respectively. The upper housing portion is coupled to the lower housing portion for pivotable movement to a closed position wherein the set of magnets is in operative relation with the transport mechanism and the mixer, and to an open position wherein the set of magnets, transport mechanism, and mixer in the interior of the housing are readily accessible. The magnets, transport mechanism, and mixer are operably rotatable when the upper housing portion is in its closed or open position.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1 is a front elevational view of an improved magnetic brush developer station according to this invention;

FIG. 9 is a side elevational view, in cross-section, of a portion of the magnetic brush developer station of FIG. 1, showing the pivotable mounting of the housing portions thereof.

DESCRIPTION OF THE PREFERRED EMBODIMENTS

Figure 2:
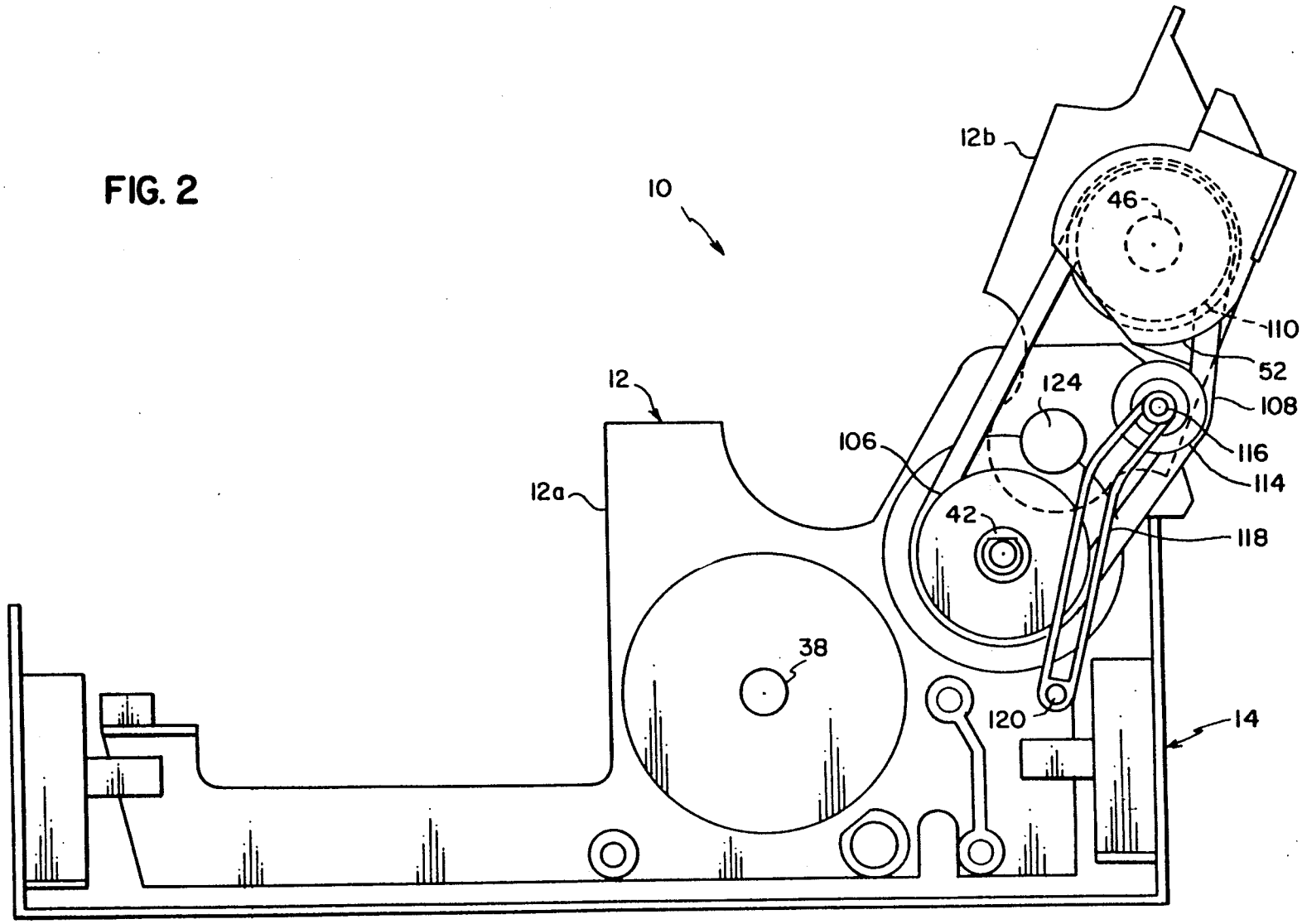
FIG. 2 is a front elevational view of the magnetic brush developer station of FIG. 1, with the housing in its open position.
Figure 3:
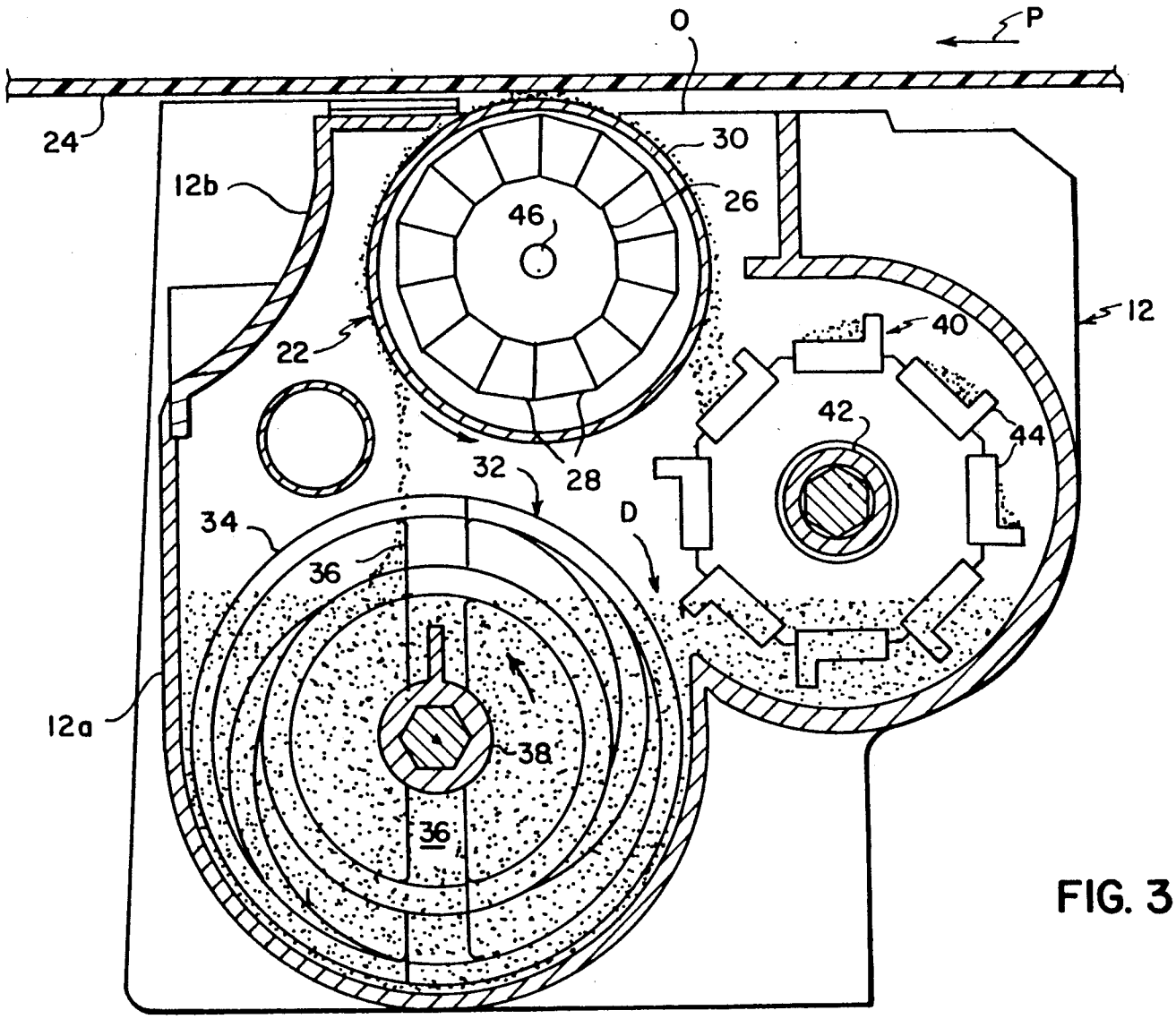
FIG. 3 is a front elevational view, in cross-section, of the magnetic brush developer station of FIG. 1.
Figure 4:
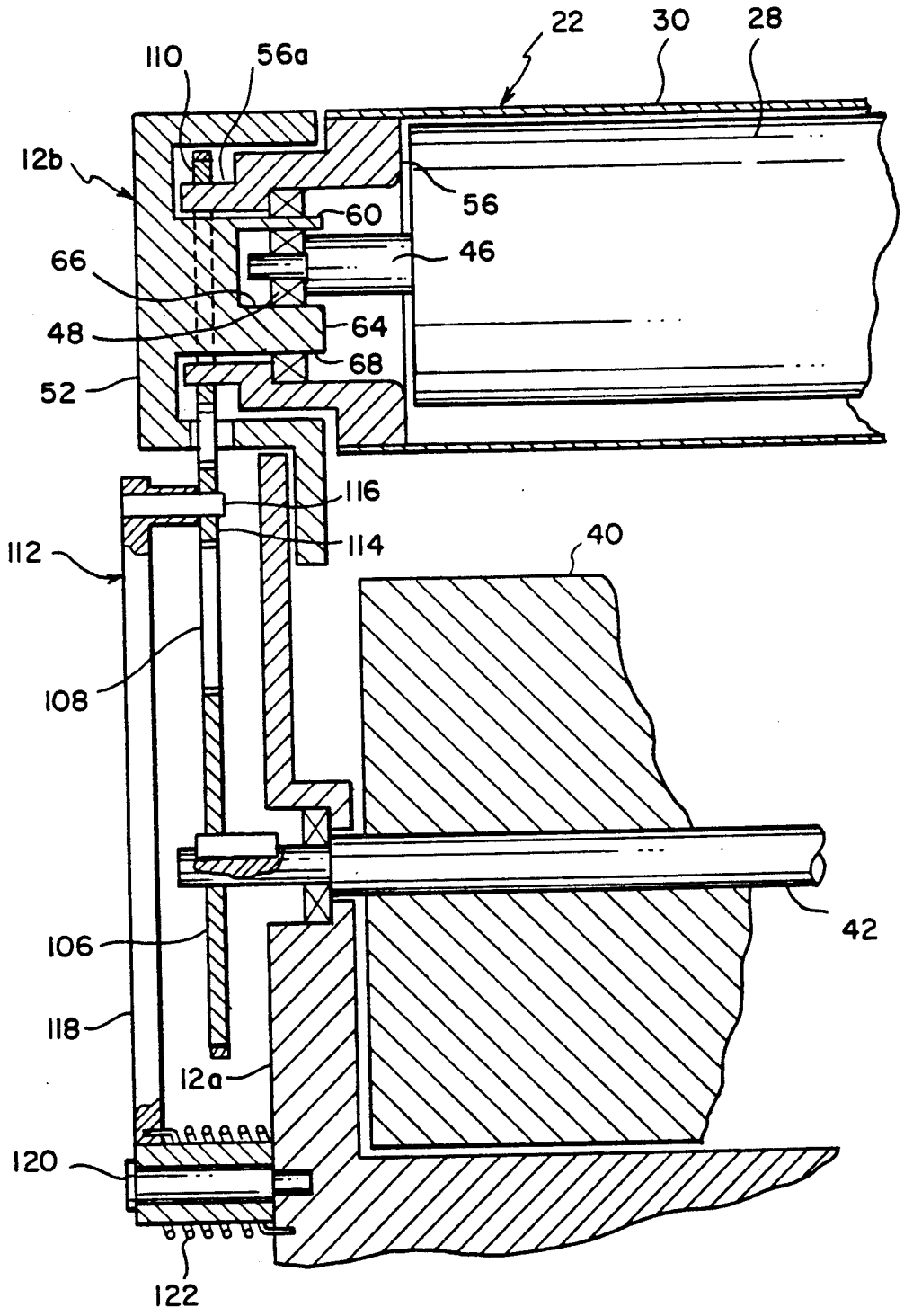
FIG. 4 is a side elevational view, in cross-section, of a portion of the magnetic brush developer station of FIG. 1, showing the shell and transport roller drive therefor.
Figure 5:
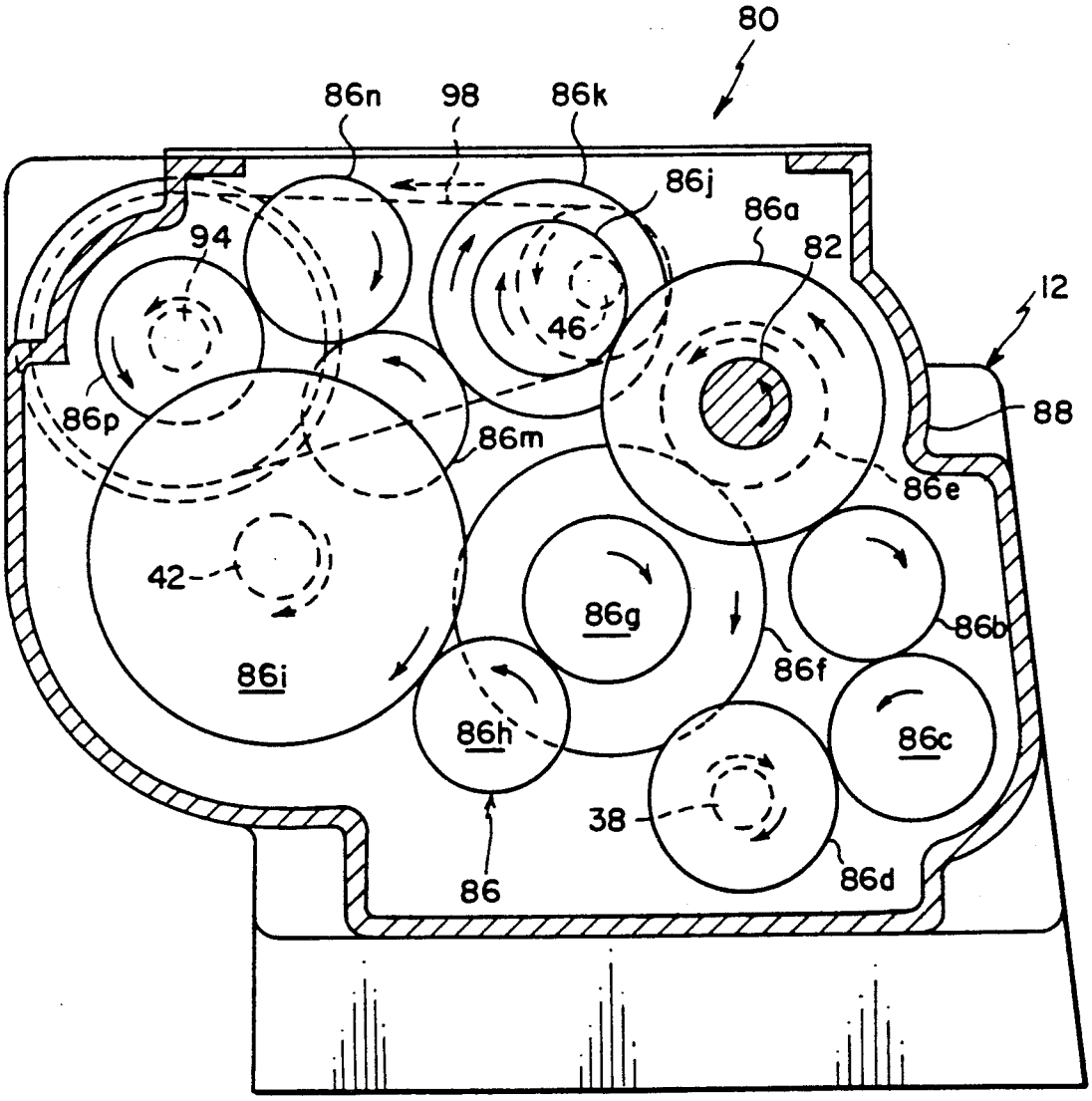
FIG. 5 is a rear elevational view, partly in cross-section, showing a gear train for driving the transporting mechanism, mixer and drive pulley for the magnetic core of the magnetic brush developer station of FIG. 1.
Figure 6:
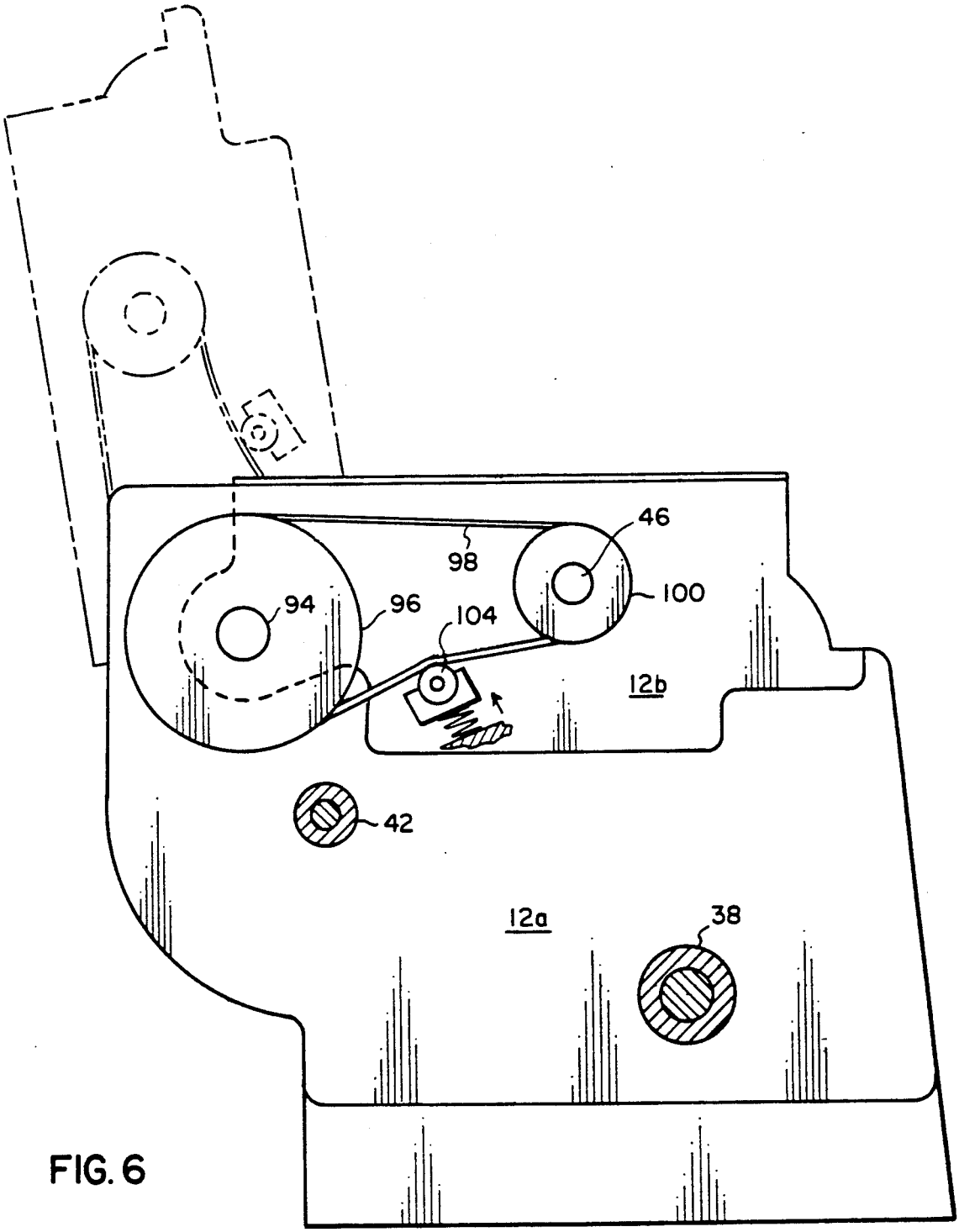
FIG. 6 is a rear elevational view, partly in cross-section, showing the drive for the magnetic core of the magnetic brush developer station of FIG. 1.

Referring now to the accompanying drawings, as shown in FIGS. 1 and 2, an improved magnetic brush developer station designated generally by the numeral 10 according to this invention includes a housing 12 supported on a carriage 14 within an electrostatographic reproduction apparatus or printer (not shown). As best seen in FIG. 3, the developer station 10 has a particular internal construction shown and more fully described in copending U.S. patent application Ser. No. 230,936, filed Aug. 11, 1988, now U.S. Pat. No. 4,878,089, in the name of Guslits et al. Of course other internal constructions for magnetic brush developer stations are suitable for use with this invention. The exemplary magnetic brush developer station of the above-mentioned Guslits et al. patent is described herein to the extent necessary for a complete understanding of this invention. Such station includes intercommunicating portions 12*a*, 12*b* for the housing 12. The lower portion 12*a* serves as a reservoir for developer material D (typically comprising magnetic carrier particles and pigmented marking particles). The upper portion 12*b* contains a magnetic brush 22 for applying marking particles of the developer material to charge patterns formed on a dielectric member 24 moving along a path P in juxtaposition to an opening O in the upper housing portion.

The magnetic brush 22 includes a core 26 supported on a shaft 46. The core 26 has a plurality of magnets 28 spaced around the peripheral surface thereof. A non-magnetic substantially cylindrical shell 30 surrounds the core 26 and has its longitudinal axis offset from the longitudinal axis of the core shaft. Such offset is for the purpose of decreasing the field strength of the magnets 28 over the area of the shell 30 spaced farther from the magnets so that the developer material has less propensity to adhere to the shell in that area and readily returns to the reservoir. Developer material D within the reservoir formed by the housing portion 12*a* is stirred by a mixer 32. The mixer 32 is for example a ribbon blender such as fully described in U.S. Pat. No. 4,634,286 issued Jan. 6, 1987, in the name of Pike. The ribbon blender includes helical ribbons 34 connected by rods 36 to a shaft 38. The shaft 38 is supported in the housing portion 12*a* for rotation about the longitudinal axis of such shaft. The pitch of the ribbons 34 are such that, as the shaft 38 rotates the ribbons, developer material is moved along the length of the blender, and the material is agitated to provide a triboelectric charge which causes the marking particles to adhere to the carrier particles. Of course, other types of mixers, such as paddle wheels or augers for example, are suitable for use with this invention.

The mixer 32 also moves developer material radially with respect to the mixer so that the material is moved into an adjacent section of the portion 12*a* of the housing 12. A transporting mechanism 40, located within this housing section, serves to transport developer material into the field of the magnets 28 of the magnetic brush 22. The transport mechanism 40 includes roller mounted on a shaft 42 which is, in turn, rotatably supported by the housing portion 12*a*. A plurality of pickup members 44 are located about the periphery of the roller and extend respectively along the full length thereof. As the roller of the transporting mechanism 40 is rotated in the manner described hereinbelow, the pickup members 44 move through the developer material and move the material into the magnetic field of the magnetics 28 of the brush 22 where the material is readily attracted to the shell 30. The shell 30 is rotated counterclockwise in the manner described hereinbelow, while the core 26 (and the magnets 28) is rotated clockwise. As a result, the developer material D is moved across the opening O in the housing portion 12*b* by the magnetic brush 22 into applying relation with the charge pattern bearing member 24. An image-wise charge pattern on the dielectric member attracts marking particles from the developer material into adhering relationship with the charge pattern to develop such pattern. The developed pattern can then be subsequently transferred to a final receiver sheet and fixed thereto by heat and/or pressure, or may be fixed directly on the dielectric member.

With the above described internal construction of the magnetic brush developer station 10, access to the internal elements is provided according to this invention by arranging portions 12*a* and 12*b* of the housing 12 so that portion 12*b* can pivot from the closed position of FIG. 1 to the open position shown in FIG. 2 without decoupling the drive to various internal elements. As shown in FIGS. 4–9, the construction by which the non-decoupling, pivot arrangement of the magnetic brush development station 10 is provided is as follows:

Portion 12*b* of the housing 12 has a pair of end caps 52 (FIG. 4) and 54 (FIG. 8) formed therein. End cap 52 includes a hub 64 having an internal bore 66 and an external surface 68. The bore 66 is eccentrically positioned within the hub 64. End cap 54 similarly has a hub 70 having an eccentrically positioned bore 72. The shaft 46, on which the magnet-supporting core 26 of the magnetic brush 22 is mounted, is carried at its ends in bearings 48 and 50 respectively supported by end caps 52 and 54 formed in the portion 12*b* of the housing 12 (see FIGS. 4 and 8). The shell 30 of the magnetic brush 22 has gudgeons 56 (FIG. 4) and 58 (FIG. 8) fitted in the ends thereof, such gudgeons being respectively carried in bearings 60 and 62. Bearing 48 is located within the bore 66 of the hub 64 of the end cap 52 and bearing 60 located on the external surface 68 of such hub; and, bearing 50 is located within the bore 72 of the hub 70 of the end cap 54 and bearing 62 located on the external surface of such hub. The eccentricity of the respective bores 66 and 72 enable the core 26 and the shell 30 of the magnetic brush 22 to have the aforementioned desired offset, and the independent support of the respective support bearings enables the core and shell to be capable of independent rotation about their offset longitudinal axes. The described independent rotation of the core 26 and the shell 30 of the magnetic brush 22 is necessary since, for maximum efficient development of charge patterns on the dielectric member 24 by the development station 10, the core rotates in one direction at a first speed and the shell rotates in an opposite direction at a second substantially reduced speed. As an illustrative example, the core 26 may rotate clockwise (in FIG. 1) at 1200 RPM, while the shell rotates counterclockwise at 60 RPM.

In addition to providing rotary drive for the core 26 and shell 30 of the magnetic brush 22, the mixer 32 and transporting mechanism 42 must also be rotatably driven. An improved, non-decoupling, drive arrangement 80 according to this invention is provided which enables the portion 12*b* of the housing 12 of the magnetic brush 22 to be opened to provide access to the interior of the magnetic brush without disconnecting the drive for the various elements. The drive arrangement 80 includes a main drive shaft 82 adapted to be coupled to a motor 84 (shown in phantom in FIGS. 7 and 7*a*). The drive shaft 82 serves as the rotational drive input to a gear train 86 supported in a gear box 88 associated with the housing 12 of the magnetic brush developer station 10. In the gear train 86 (see FIGS. 5, 7 and 7*a*): gear 86*d* is drivingly coupled to the shaft 38 (the drive shaft for the ribbons 34 of the mixer 32); gear 86*i* is drivingly coupled to the shaft 42 (the drive shaft for the transporting mechanism 40); and gear 86*p* is drivingly coupled to an output shaft 94.

Figure 7:
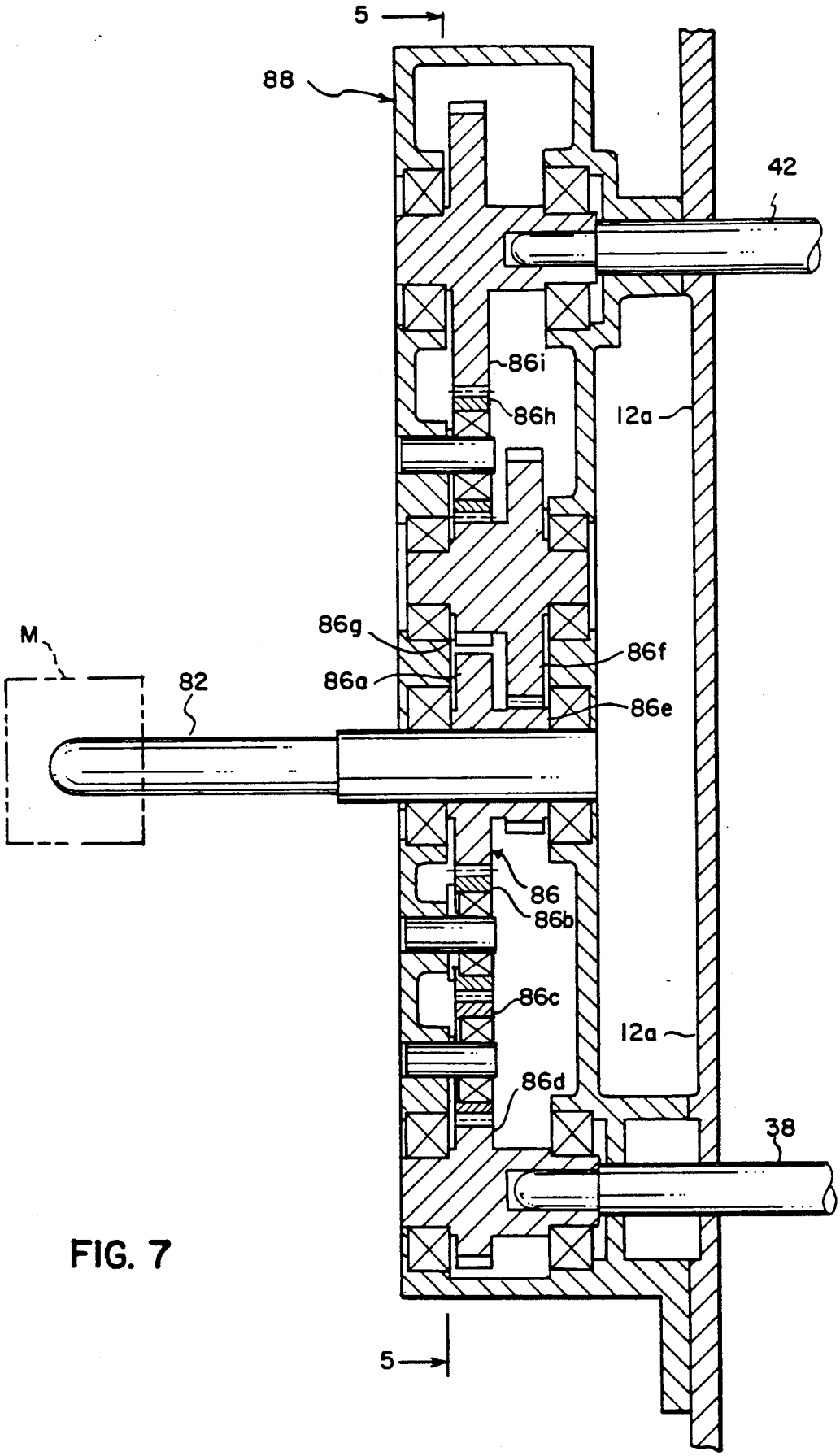
FIGS. 7 and 7*a* are side elevational views, partly in cross-section, showing layouts of the gear train of FIG. 5.
Figure 7A:
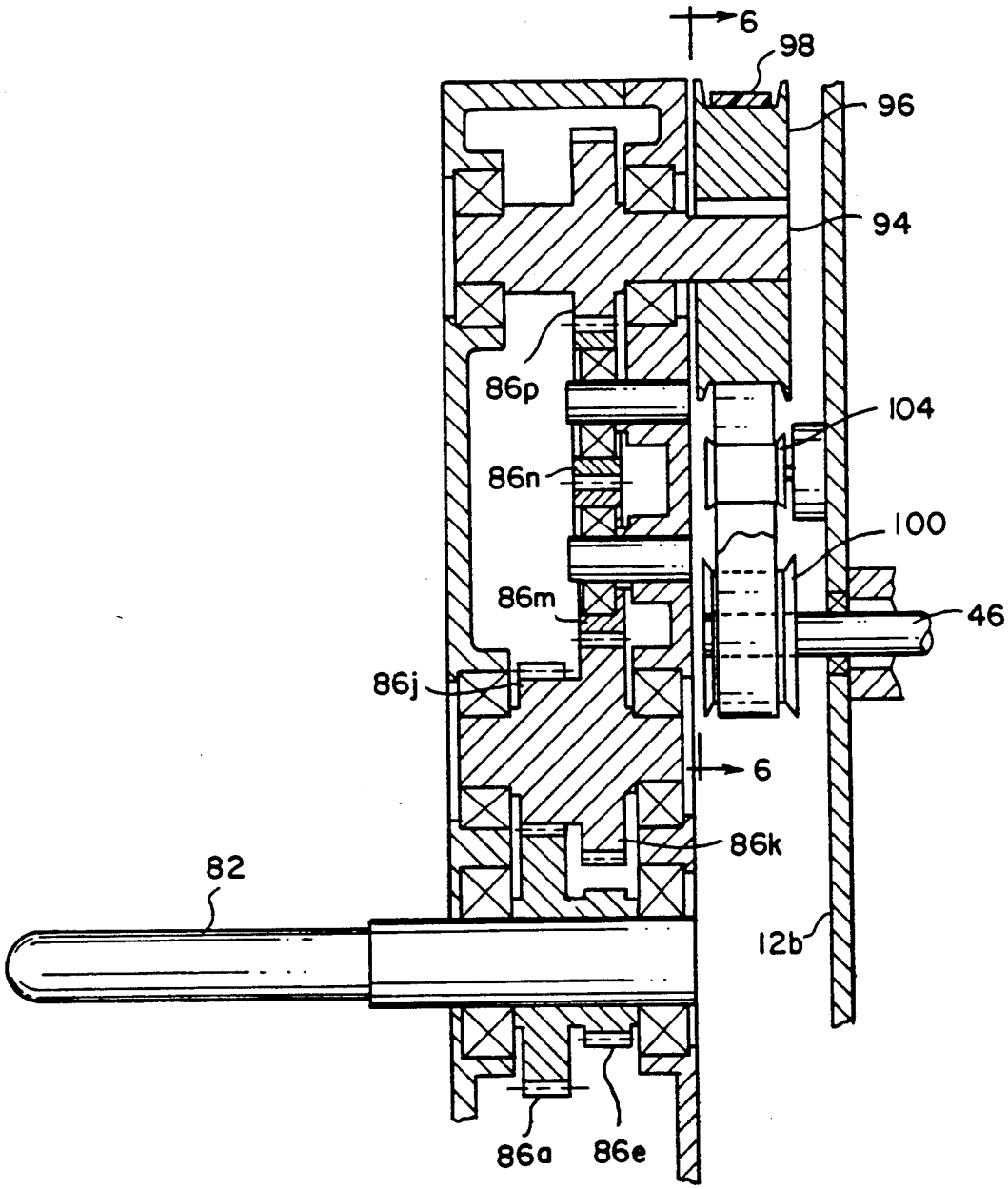
Figure 8:
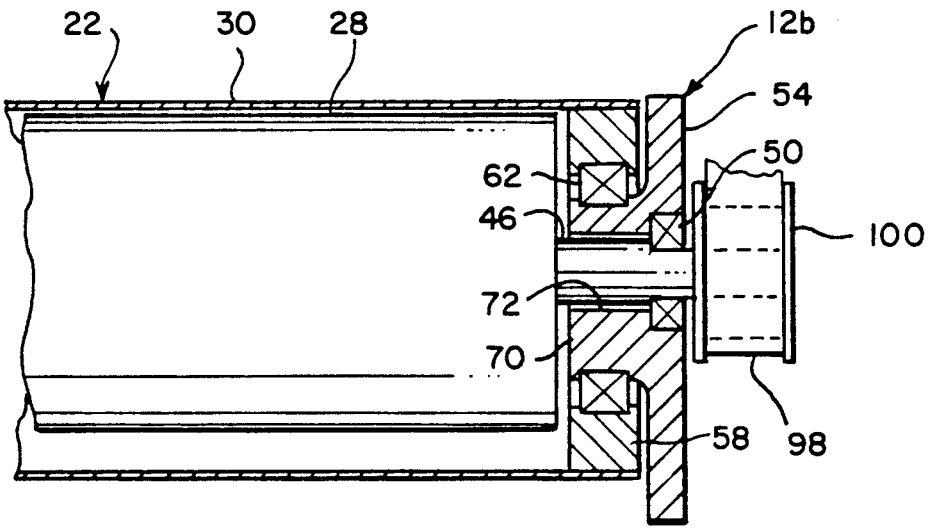
FIG. 8 is a side elevational view, partly in cross-section, of a portion of the magnetic brush developer station of FIG. 1, showing the core drive therefor.

The output shaft 94 from the gear train 86 provides rotational drive for the core 26 (see FIGS. 7*a* and 8). In order to drive the core 26, a pulley 96 is fixed on the shaft 94 for rotation therewith. A continuous belt 98 is entrained about pulley 96 and a pulley 100 fixed on the shaft 46 of the core 26 for rotation therewith. A spring-urged tension roller 104 (see FIG. 6), supported on the housing portion 12*b*, contacts the belt 98 and assures that the belt will effect transmission of rotation from the pulley 96 to the pulley 100.

Rotation of the main drive shaft 82, by the motor 84, in a counterclockwise direction (when viewed as in FIG. 5) causes clockwise rotation of the shaft 38 through the gears 86*a*, 86*b*, 86*c*, and 86*d*; clockwise rotation of the shaft 42 through gears 86*e*, 86*f*, 86*g*, 86*h*, and 86*i*; and counterclockwise rotation of the shaft 94 through gears 86*a*, 86*j*, 86*k*, 86*m*, and 86*n*. The size relationship of gears 86*a*, 86*b*, 86*c*, and 86*d* is preselected such that the rotational speed of the ribbons 34 of the mixer 32 is sufficient to cause adequate mixing of the developer material D in the reservoir formed by housing portion 12*a*, and feeding of the material to the transporting mechanism 40; and the size relationship of the gears 86*e*, 86*f*, 86*g*, 86*h*, and 86*i* is preselected such that the rotational speed of the transporting mechanism 40 delivers a sufficient quantity of developer material to the magnetic brush 22. Similarly, the size relationship of the gears 86*a*, 86*j*, 86*k*, 86*m*, and 86*n*, and the size relationship of the pulleys 96 and 100, are preselected such that the rotational speed of the shaft 94 is sufficient to assure rotation of the shaft 46 of the core 26 at a speed which will result in movement of the core magnets 28 to provide sufficient movement of the developer material D through the development zone in contact with the dielectric member 24 for efficient development of charge patterns carried by the photoconductive member.

The end 42*a* (see FIG. 4) of the transporting mechanism shaft 42 remote from the gear 86*i* has a gear 106 fixed thereto for rotation with such shaft. A drive chain or belt 108 is entrained about the gear 106 and a gear 110 fixed on a land 56*a* of the shell gudgeon 56. The drive belt 108 is maintained under tension, to assure transmission of rotation of the gear 110 on rotation of the gear 106, by a tensioning assembly 112. The tensioning assembly 112 includes a gear 114, in engagement with the the belt 108, rotatably mounted on a pin 116 carried by a pivot arm 118. The pivot arm 118 has an end bushing 118*a* mounted on a pivot pin 120 supported by the housing portion 12*a*. A torsion spring 122, connected at one end to the arm 118 and at the other end to the housing portion 12*a*, urges the arm in a direction (clockwise in FIGS. 1 and 2) to maintain the desired tension in the belt 108.

As noted above, an important aspect of the drive for the mixer 32, transporting mechanism 40, and the core 26 and shell 30 of the magnetic brush 22 is that the portions 12*a* and 12*b* of the housing 12 of the magnetic brush developer station 10 can be opened to provide ready access to the interior of the station without decoupling any of the drive transmission arrangements. The elements of the station 10 can thus be serviced and readily repaired on site, and it is assured that when the housing is closed the various drives will all be functional without necessitating any complicated adjustments or alignment. According to this invention, portion 12*a* of the housing 12 includes a hub 124 upon which a receiving member 126 of housing portion 12*b* is pivotably supported (see FIGS. 1, 2, and 9). The pivot axis A for portion 12*b*, formed by the hub 124, is coaxial with the longitudinal axis of the shaft 94. In this manner, when portion 12*b* is moved from its closed position (solid line position of FIG. 6) to its open position (phantom line position of FIG. 6), pulley 96 mounted on the shaft 94 maintains its axial location relative to housing portion 12*a*. Accordingly, none of the gears in the gear train 86 within the gear box 88 attached to the housing portion 12*a*, have to be disengaged, and the spatial relation between pulleys 96 and 100 does not change. Further, drive belt 98 remains under tension so that the driving arrangement between the pulleys by the belt is not disengaged. At the same time, gear 110 is moved with portion 12*b* to its position shown in FIG. 2. In such position, the relative distance between the axes of the gears 110 and 106 changes. However, the spring 122 urges the arm 118, in the manner described above, in a direction (to the left in FIG. 2) to maintain sufficient tension on the belt 108 to retain the belt in driving engagement with the gears 110 and 106. Accordingly, when the housing portion 12*b* returns to its closed position, drive readiness of the belts 98 and 108 is assured.

The invention has been described in detail with particular reference to a preferred embodiment thereof, but it will be understood that variations and modifications can be effected within the spirit and scope of the invention.

We claim:

1. An improved magnetic brush developer station having a plurality of members including at least one set of magnets, a developer transport mechanism, and a developer material mixer, the improvement comprising;

a housing having an upper portion and a lower portion, said upper portion including means for rotatably supporting said set of magnets, and said lower portion providing a reservoir adapted to contain developer material, and including means for rotatably supporting said transport mechanism and said mixer;

means for connecting said upper housing portion to said lower housing portion for pivotable movement about an axis to a closed position wherein said set of magnets is in operative relation with said transport mechanism and said mixer, and to an open position wherein said set of magnets, transport mechanism, and mixer in the interior of said housing are readily accessible; and means, operable when said upper housing portion is in its closed or open position, for rotating said set of magnets, said transport mechanism, and said mixer respectively.

2. The invention of claim 1 wherein said rotating means includes a gear box mounted on said lower housing portion, a gear train supported within said gear box, an input shaft coupled to said gear train and adapted to be rotatably driven by a motor, a plurality of output shafts coupled respectively to elements of said gear train, and means for coupling said output shafts to said transport mechanism, said mixer, and said set of magnets respectively.

3. The invention of claim 2 wherein said means for coupling an output shaft to said set of magnets includes a first pulley mounted on such output shaft for rotation therewith, a second pulley associated with said means for rotating said set of magnets for rotation with said set of magnets, a continuous drive belt entrained about said first and second pulleys, and tension means for maintaining said drive belt in driving engagement with said first and second pulleys when said upper housing portion is in either its open or closed position.

4. The invention of claim 3 wherein the axis of rotation of said first pulley and the pivot axis of said means for connecting said upper housing portion to said lower housing portion are coaxial.

5. The invention of claim 1 wherein said connecting means includes a hub defined by said lower housing portion, and a complimentary receiver defined by said upper housing portion, said receiver receiving said hub whereby said upper housing portion is pivotable relative to said lower housing portion about said hub.

6. An improved magnetic brush developer station having a plurality of members including a magnetic brush assembly having at least one set of magnets surrounded by a shell, a developer transport mechanism, and a developer material mixer, the improvement comprising:

a housing having an upper portion and a lower portion, said upper portion including means for supporting said set of magnets and said shell for rotation, and said lower portion providing a reservoir adapted to contain developer material, and including means for rotatably supporting said transport mechanism and said mixer; and means for connecting said upper housing portion to said lower housing portion for pivotable movement about an axis to a closed position wherein said set of magnets and said shell are in operative relation with said transport mechanism and said mixer, and to an open position wherein said shell, transport mechanism, and mixer in the interior of said housing are readily accessible; and means, operable when said upper housing portion is in its closed or open position, for rotating said set of magnets, said shell, said transport mechanism, and said mixer respectively, said rotating means including a gear box mounted on said lower housing portion, a gear train supported within said gear box, an input shaft coupled to said gear train and adapted to be rotatably driven by a motor, a plurality of output shafts coupled respectively to elements of said gear train, and means for coupling said output shafts to said transport mechanism, said mixer, said set of magnets and said shell respectively.

7. The invention of claim 6, wherein said means for coupling an output shaft to said set of magnets includes a first pulley mounted on such output shaft for rotation therewith, a second pulley associated with said means for rotating said set of magnets for rotation with said set of magnets, a continuous drive belt entrained about said first and second pulleys, and tension means for maintaining said drive belt in driving engagement with said first and second pulleys when said upper housing portion is in either its open or closed position.

8. The invention of claim 7 wherein the axis of rotation of said first pulley and the pivot axis of said means for connecting said upper housing portion to said lower housing portion are coaxial.

9. The invention of claim 6 wherein said means for coupling an output shaft to said shell includes a first gear mounted on such output shaft for rotating said transport mechanism for rotation therewith, a second gear associated with said shell for rotation therewith, a continuous drive belt entrained about said first and second gears, and tension means for maintaining said drive belt in driving engagement with said first and second gears when said upper housing portion is in either its open or closed position.

10. The invention of claim 9 wherein said output shaft for rotating said transport mechanism extends through said transport mechanism, and said first gear is mounted on the end of such shaft opposite the end of such shaft coupled to said gear train.

11. The invention of claim 6 wherein said connecting means includes a hub defined by said lower housing portion, and a complimentary receiver defined by said upper housing portion, said receiver receiving said hub whereby said upper housing portion is pivotable relative to said lower housing portion about said hub.

12. A magnetic brush developer station comprising:

a magnetic brush assembly including a shaft, at least one set of magnets mounted on said shaft to assume a substantially cylindrical configuration, a shell surrounding said set of magnets, a developer transport mechanism, and a developer material mixer;

a housing having an upper portion and a lower portion, said upper portion including means for supporting said set of magnets and said shell for rotation, and said lower portion providing a reservoir adapted to contain developer material, and including means for rotatably supporting said transport mechanism and said mixer;

means for connecting said upper housing portion to said lower housing portion for pivotable movement about an axis to a closed position wherein said set of magnets and said shell are in operative relation with said transport mechanism and said mixer, and to an open position wherein said shell, transport mechanism, and mixer in the interior of said housing are readily accessible; and means, operable when said upper housing portion is in its closed or open position, for rotating said set of magnets, said shell, said transport mechanism, and said mixer respectively.

13. The invention of claim 12 wherein said shell includes a pair of end gudgeons, said end gudeons carrying bearings for supporting said magnetic brush assembly shaft for relative rotation with respect to said shell with the longitudinal axis of said shaft being parallel to and offset from the longitudinal axis of said shell.

14. The invention of claim 13 wherein said means of said upper housing portion for supporting said set of magnets and said shell includes a pair of end caps, said end caps respectively including a hub having an internal bore and an external surface, said bore being eccentrically positioned within said hub, said bearings for supporting said magnetic brush assembly shaft are located within said bores of said end caps, and bearings, located on said external surfaces of said respective hubs support said end gudgeons, whereby the eccentricity of the respective bores enable said set of magnets and said shell to have said desired offset, and the independent support of the respective support bearings enables said set of magnets and shell to be capable of independent rotation about their offset longitudinal axes.

15. The invention of claim 14 wherein said rotating means includes a gear box mounted on said lower housing portion, a gear train supported within said gear box, an input shaft coupled respectively to elements of said gear train and adapted to be rotatably driven by a motor, a plurality of output shafts coupled to said gear train, and means for coupling said output shafts to said transporting mechanism, said mixer, said set of magnets and said shell respectively.

16. The invention of claim 15 wherein said means for coupling an output shaft to said set of magnets includes a first pulley mounted on such output shaft for rotation therewith, a second pulley associated with said means for rotating said set of magnets for rotation with said set of magnets, a continuous drive belt entrained about said first and second pulleys, and tension means for maintaining said drive belt in driving engagement with said first and second pulleys when said upper housing portion is in either its open or closed position.

17. The invention of claim 16 wherein the axis of rotation of said first pulley and the pivot axis of said means for coupling said upper housing portion to said lower housing portion are coaxial.

18. The invention of claim 15 wherein said means for coupling an output shaft to said shell includes a first gear mounted on such output shaft for rotating said transport mechanism for rotation therewith, a second gear associated with said shell for rotation therewith, a continuous drive belt entrained about said first and second gears, and tension means for maintaining said drive belt in driving engagement with said first and second gears when said upper housing portion is either its open or closed position.

19. The invention of claim 18 wherein said out shaft for rotating said transport mechanism exte through said transport mechanism, and said first gea mounted on the end of such shaft opposite the enc such shaft coupled to said gear train.

20. The invention of claim 12 wherein said conn ing means includes a hub defined by said lower hous portion, and a complimentary receiver defined by s upper housing portion, said receiver receiving said whereby said upper housing portion is pivotable r tive to said lower housing portion about said hub.

* * * * *